US005455754A

United States Patent [19]

Hoffner

[11] Patent Number: 5,455,754

[45] Date of Patent: Oct. 3, 1995

[54] DEVICE FOR THE SUPPORT AND POWER SUPPLY OF VERY LOW VOLTAGE LIGHTING

[75] Inventor: Max Hoffner, Hirsingue, France

[73] Assignee: Applications Techniques et Decoratives de l'Eclairage SA, France

[21] Appl. No.: 108,666

[22] PCT Filed: Jan. 6, 1993

[86] PCT No.: PCT/FR93/00008

§ 371 Date: Aug. 26, 1993

§ 102(e) Date: Aug. 26, 1993

[87] PCT Pub. No.: WO93/14347

PCT Pub. Date: Jul. 22, 1993

[30] Foreign Application Priority Data

Jan. 6, 1992 [FR] France ..... 92 00174

[51] Int. Cl.[6] ..... F21V 21/14

[52] U.S. Cl. ..... 362/250; 362/147; 362/226; 362/404

[58] Field of Search ..... 362/226, 239, 362/249, 250, 391, 396, 147, 404

[56] References Cited

U.S. PATENT DOCUMENTS 5,203,626 4/1993 Clement ..... 362/250

FOREIGN PATENT DOCUMENTS 291989 11/1988 European Pat. Off. .
0320661 6/1989 European Pat. Off. .
424979 5/1967 Switzerland .

*Primary Examiner*—Stephen F. Husar
*Attorney, Agent, or Firm*—Davis, Bujold & Streck

[57] ABSTRACT

Device for the support and power supply of very low voltage lighting, for example 12 V, by means of non-sheathed conducting rails, resulting in very stable and aesthetic lamps. Each rail (1) is composed of two identical conducting rods (15) connected by an intermediate insulating strip (16), the edges (17) of which are projecting. The general profile of the rail is polygonal and includes opposite grooves (27) on each conducting rod, for firmly securing plates serving to connect the rails to one another or to lamps. The rail comprises flat upper and lower surfaces (20, 21) against which suspension clamps or magnetically fixed electrical connectors can be applied. Application in home lighting appliances or display areas.

9 Claims, 5 Drawing Sheets

DEVICE FOR THE SUPPORT AND POWER SUPPLY OF VERY LOW VOLTAGE LIGHTING

Figure 1:
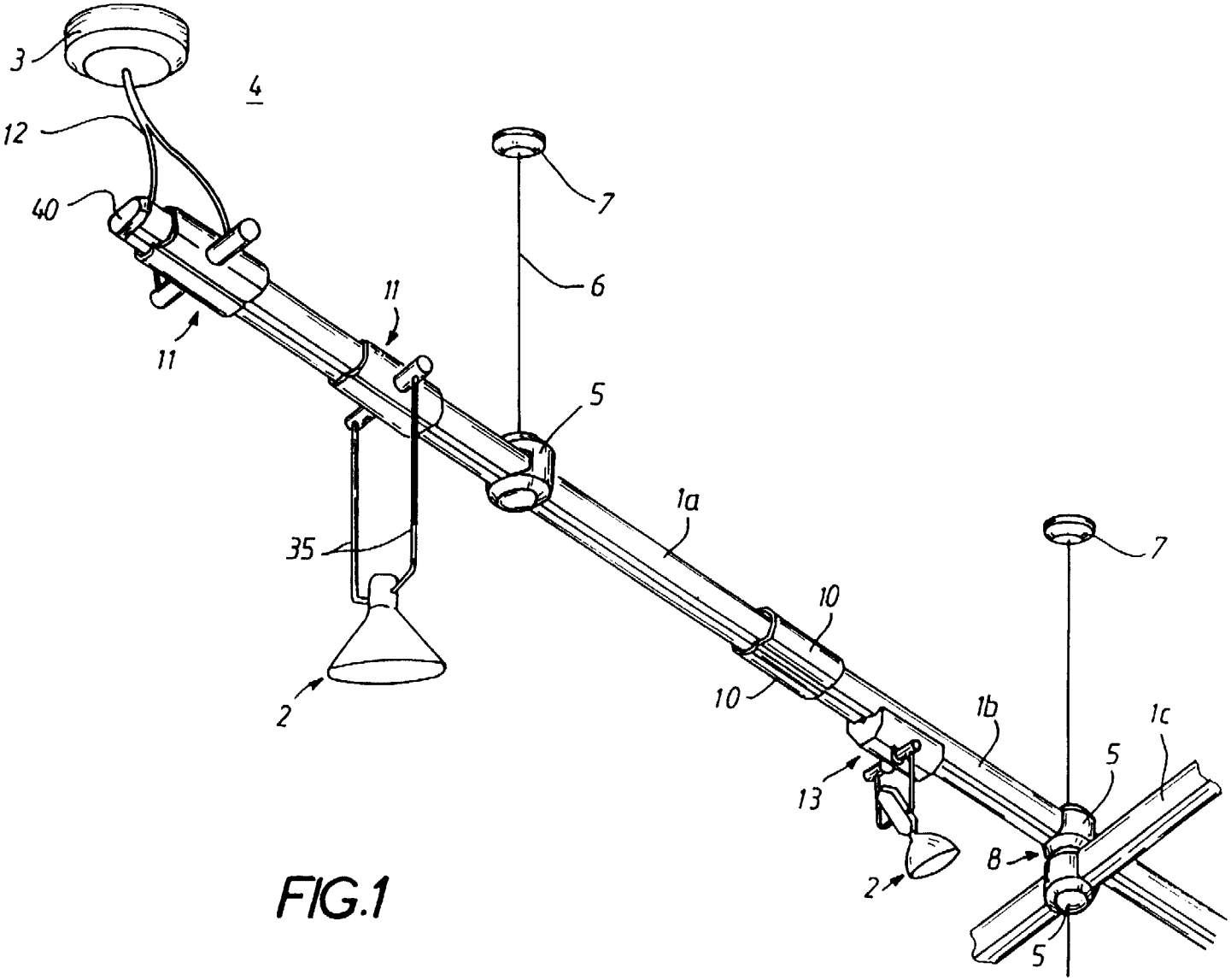

The present invention concerns a device for supporting and powering with low voltage a Lighting installation equipped with one or more lamps, including:

at least one section rail made up of two conducting bars separated by an insulator extending along the middle plane of the rail, insulating suspension means to secure the rail or rails to some bearing structure, means of supplying low voltage current, connected to the two conducting bars of a rail, and at least one branching device designed to be mounted in a position adjustable lengthwise on the rail and supporting a lamp, said device including two contact elements which are applied respectively against the conducting bars and which connect the lamp electrically to the rail. Low voltage lighting installations, usually 12 volt current, are used especially in commercial or artistic exhibitions and in living quarters, on account of their adaptability in providing well spread lighting or for spotlighting objects using several halogen lamps of the "spotlight" type. The lamps can be placed and moved easily, to put them in selected positions along two-pole conducting rails or pairs of cables serving the same purpose. Thanks to the low voltage, the conductors do not need any protective insulating sheath and can thus take connecting devices directly serving the dual function of supporting and powering the respective lamps.

One known type of rail is described in the application for European patent EP-291 989. It essentially requires an initial upside-down U section conducting bar provided with two outside lengthwise grooves, a second conducting bar located at the centre of the first one, an insulating support part set between the two bars, and an adapter for a low voltage light fixture so designed as to take hold on the two grooves. Such a device uses parts of complex shape, making them hard to machine and to install on the spot. Furthermore, the outer appearance of such a device is not eye-pleasing enough to suit the purpose of the lighting installations described above.

In such installations, another well known type of section rail, used in making up a support and two-pole power feed network for lamps, is made up of two round steel bars, laid side by side and bonded by an intermediary strip of synthetic dielectric material. Compared with a network of taut cables, this type of rail is advantageous on the score of rigidity, pleasing appearance, and ease in installing. On the other hand, it has certain disadvantages concerning devices for joining and branching off which have to be secured to the rails to connect them together or to the lamps. Each of these devices must individually surround a conducting bar, the circular section of which means that said devices must be secured either by clamping them tight and durably so, possibly leaving marks on the bars. Branching devices secured magnetically can be provided, but applying them to round bars does not allow adequate stability in positioning the lamps they support.

The purpose of the present invention is to perfect a device of this kind, avoiding the disadvantages indicated above and in particular providing great stability in rails and lamps, and also great ease in installing units, thanks to junction or suspension devices which are simple, sure, and of relatively few types. An additional purpose is to make it possible to give the parts of the device an outer shape which does not detract from the overall pleasing appearance of the lighting installation.

To this end, the invention concerns a supporting and powering device of the type indicated above, characterized in that each conducting bar of a rail has a cross section defining two opposing longitudinal grooves, respectively on opposite sides of the rail, in that said opposite sides of the rail extend appreciably in planes perpendicular to the middle plane of the rail, and in that the rail has a roughly polygonal section.

The fact that the conducting rail is provided with two opposing grooves makes it possible to secure the suspension means, the power feed, and means for joining two sections of rail and for securing the branching units to connect with the lamps in a positive and sure manner, thanks to appropriate parts fitting into these grooves. Furthermore, as the rail has at least two appreciably flat opposite sides, the above-mentioned means may assume shapes that "cooperate" with the rail in securing other parts stably. In another connection, this shape can be selected freely so as to fit into the overall design of the installation in an eye-pleasing manner.

In one particularly advantageous shape, each conducting bar includes a V-shaped lengthwise groove on one side appreciably parallel to the middle plane of the rail.

Preferably, each of said opposing grooves is formed by a "step" down into the conducting bar section, next to the middle plane, and the two grooves located on the same side of the rail are separated by an outer lip of the insulation.

The device may include a protective end cap made of insulating material in one moulded part covering one end of the rail and having four parallel "fingers" that fit lengthwise into said opposing grooves.

In one particular specimen, the suspension means include insulating clamps designed to surround the rail, each clamp being made of two parts moulded from electrical insulation material which are held together by catches and which together define an opening the shape of which corresponds to the rail section. Preferably, one of the moulded parts includes a top or bottom so disposed as to face one of said flat sides of the rail and provided with an orifice for a securing means, and a pair of parallel claws extending over the lateral sides of the rail and provided with hooks extended outward, and the other part includes a pair of lateral flaps covering said claws and orifices which said hooks can catch on.

A branch circuit can be formed by an electric connector secured magnetically, design to be applied against one of said opposite sides of the rail and including a magnet set between said contact elements and secured to them, these contact elements being applied against the conducting bars by the force of magnetic attraction and supporting the lamp through two respective conducting elements.

In one advantageous specimen, the device includes steel fishplates designed to be inclosed in pairs on the pairs of conducting bars of one or more rails, in particular to connect the ends of two rails mechanically and electrically, each fishplate having a section which follows the outer section of the corresponding conducting bar, with two opposite inside edges being engaged positively in said opposite grooves of the bar, and at least two locking screws so disposed as to screw into the V-shaped groove of the bar. A positively secured branch circuit unit can include a pair of said fishplates, equipped with a pair of corresponding lateral sockets provided with securing parts for a pair of conducting elements supporting and powering a lamp.

Figure 2:
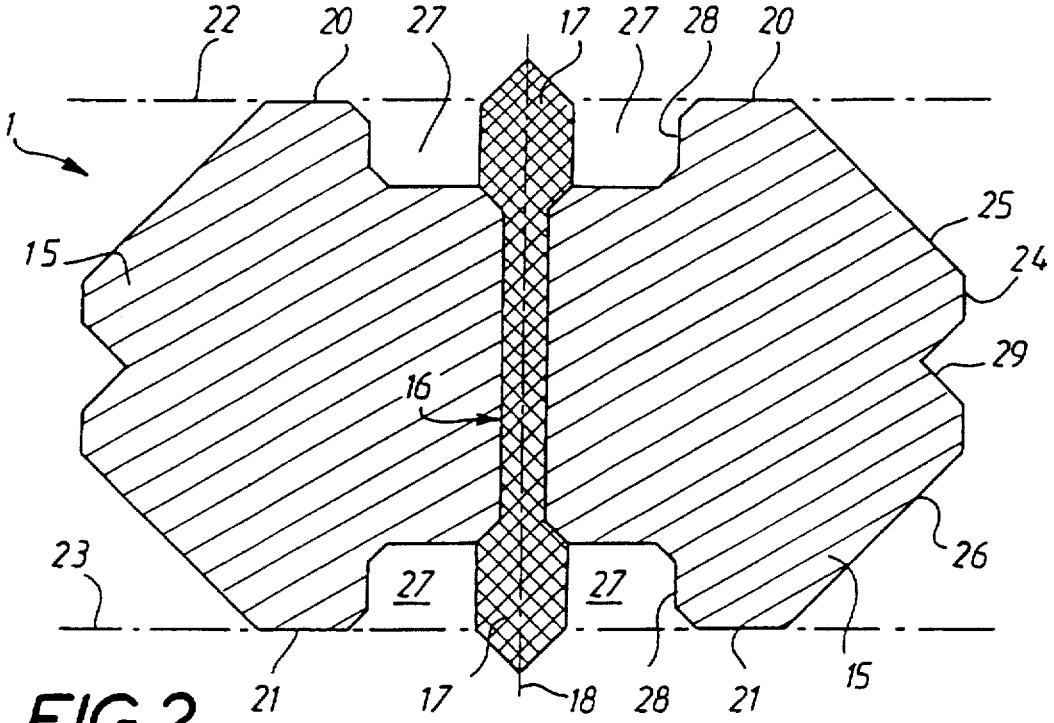
Figure 3:
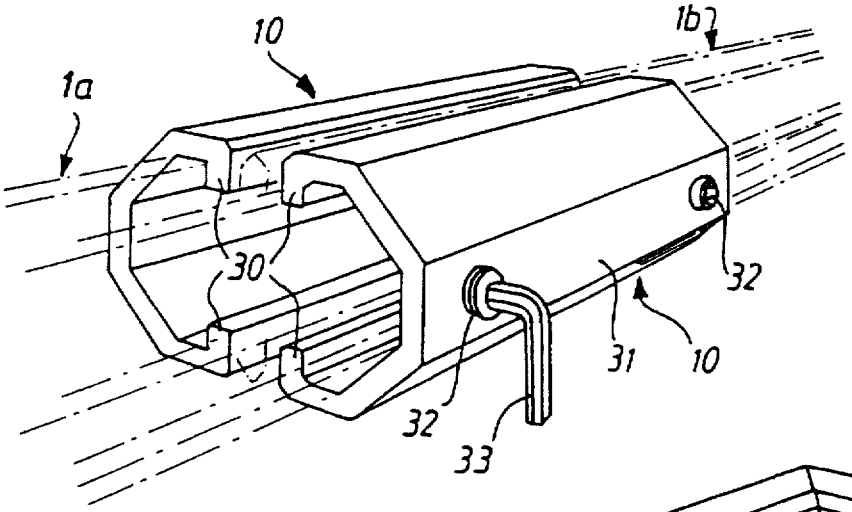
Figure 4:
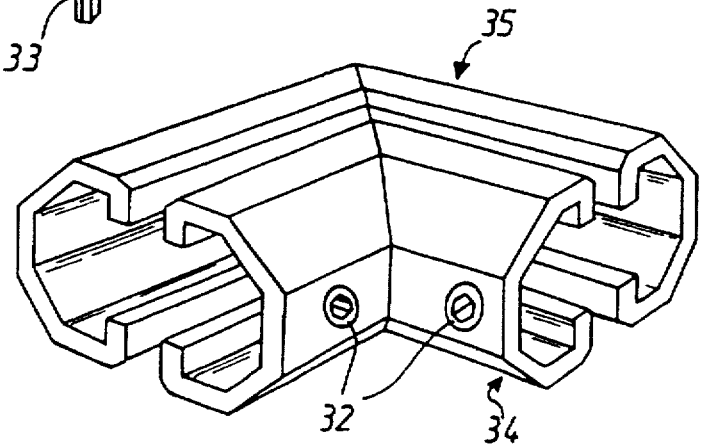
Figure 5:
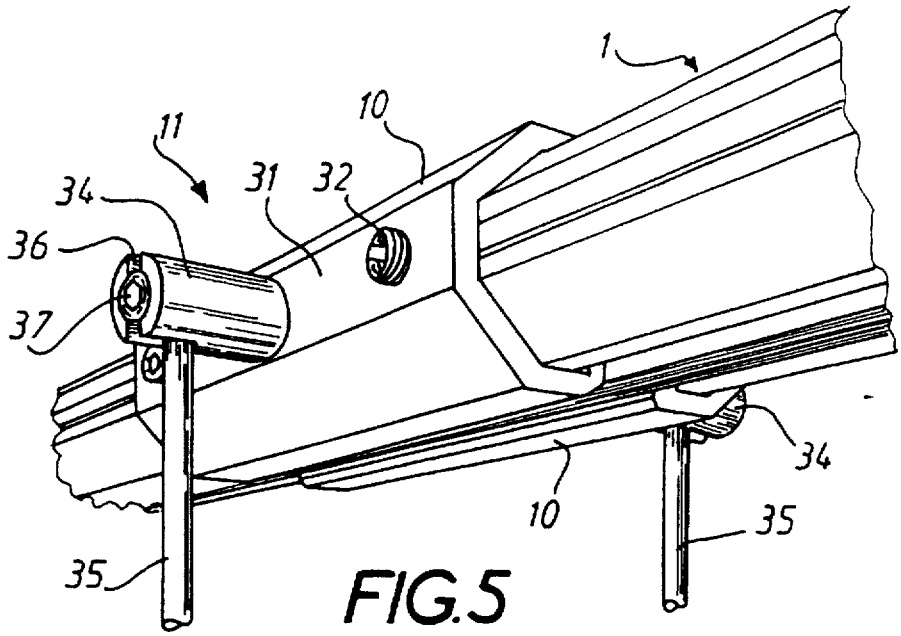
Figure 7:
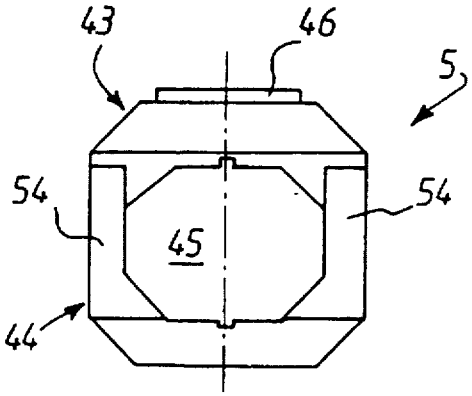
Figure 6:
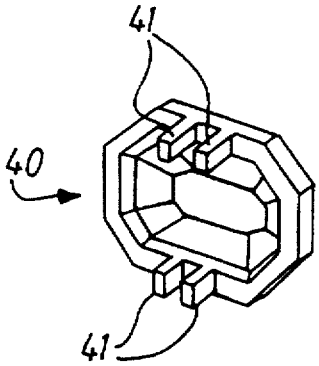
Figure 8:
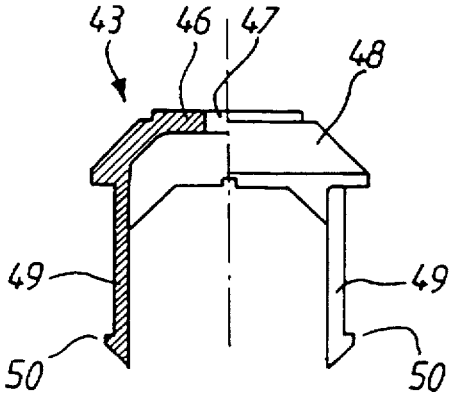
Figure 9:
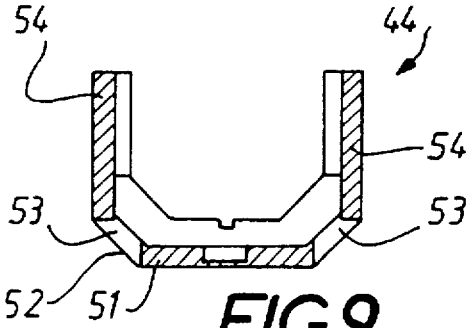
Figure 10:
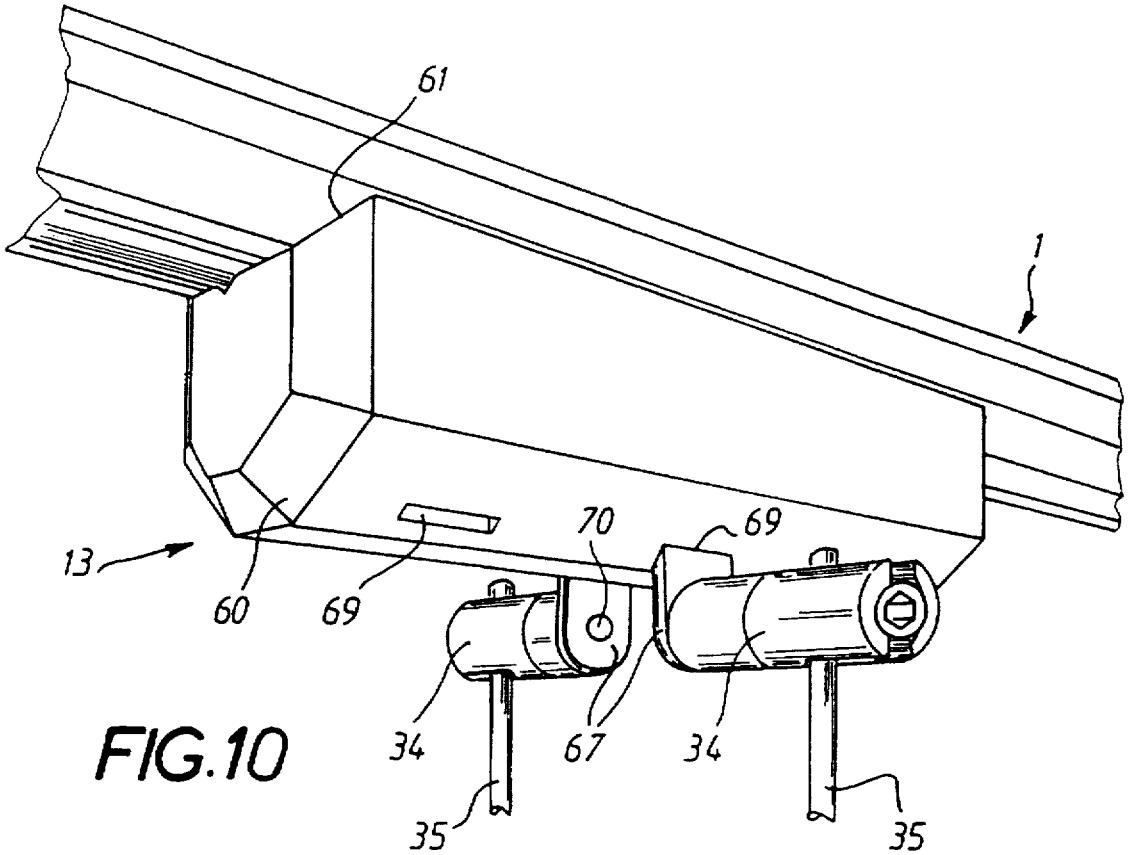
Figure 11:
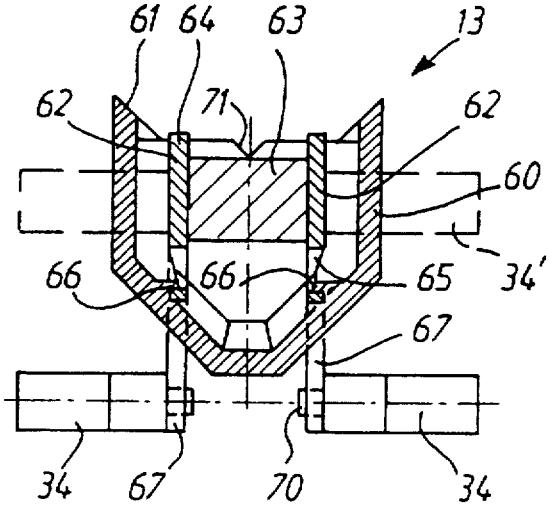
Figure 12:
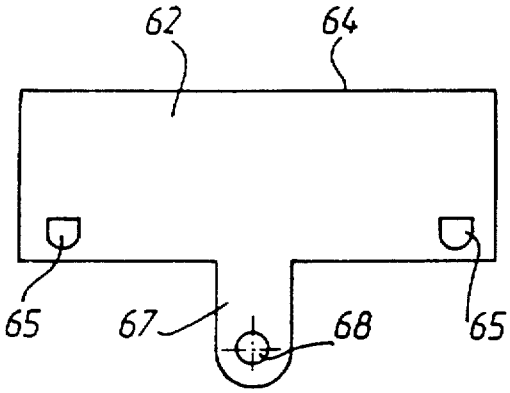
Figure 13:
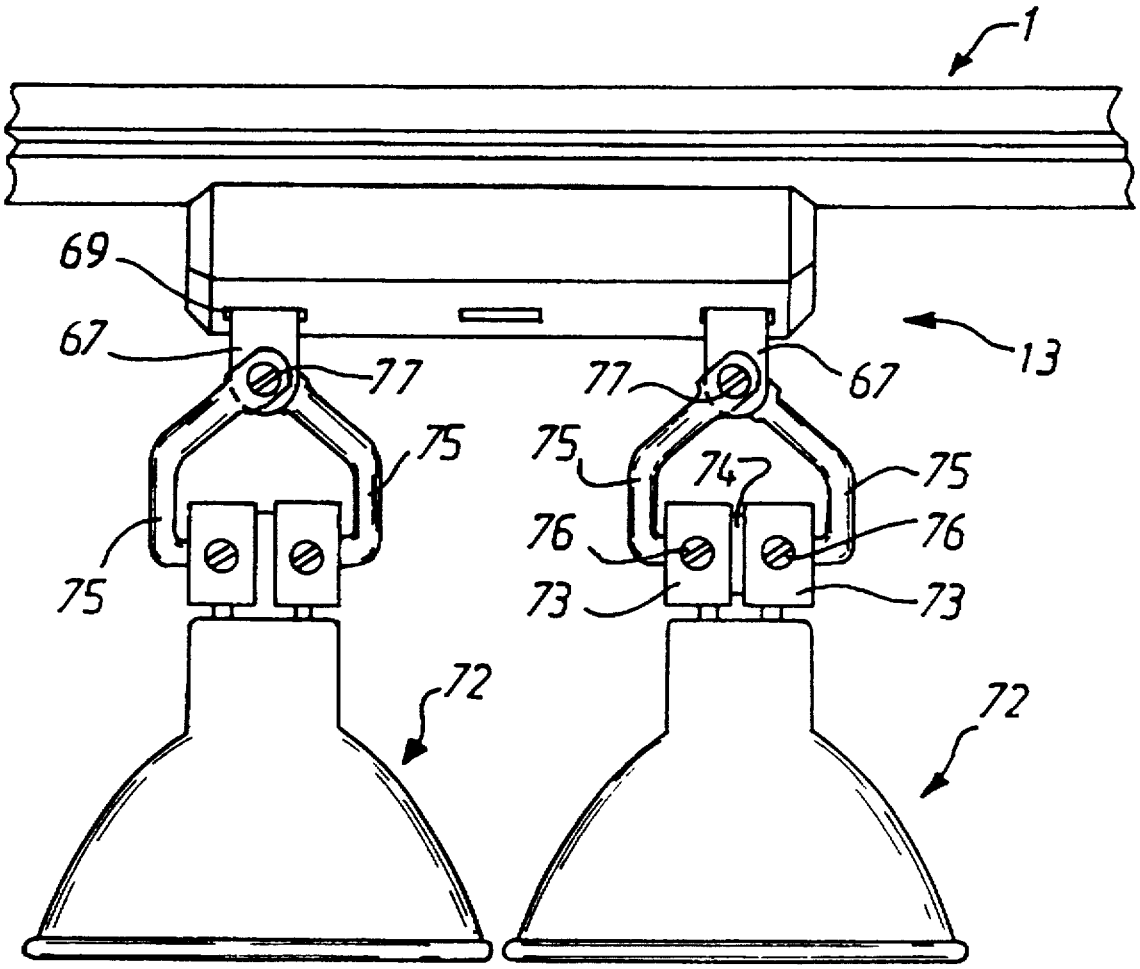

Other characteristics and advantages of the invention will appear in the following description of a specimen, references being to the appended drawings, in which:

FIG. 1 is a partial perspective view of a device according to the invention, including several conducting rails which support low voltage halogen lamps, FIG. 2 represents the cross section of a rail of the device in FIG. 1, FIGS. 3 and 4 represent steel fishplates designed to provide end-to-end mechanical and electric connection between two rails, FIG. 5 is a perspective view of a branch circuit unit as shown in FIG. 1, FIG. 6 is a perspective view of a protective end cap as shown in FIG. 1 and designed to cover one end of a rail, FIG. 7 is a front elevation of an insulating securing clamp as shown in FIG. 1, FIGS. 8 and 9 are section views of two moulded parts which together make up the clamp in FIG. 7, FIG. 10 is a perspective view of a magnetically secured electric connector as shown in FIG. 1, FIG. 11 is a cross section of the connector in FIG. 10, FIG. 12 is a side elevation of one of the two contact parts of the connector in FIG. 10, and FIG. 13 shows a variant of the connector in FIG. 10, bearing two spotlights.

The device represented in FIG. 1 is designed to support and power halogen lamps (2) on low voltage (12-volt current) supplied by a transformer (3) secured to a ceiling (4) and connected to the household electric mains. Rails (1) shown individually as Items 1*a*, 1*b*, and 1*c*, support and power the lamps and are suspended from the ceiling (4) by means of insulating securing clamps (5) secured to the suspension rods or wires (6) connected to little ring fixtures secured to the ceiling. The (1*c*) rail is suspended from the 1*b* rail where these rails cross by means of a rigid device (8) formed by assembling two collars (5), each of which surrounds one rail. This device (8) may contain a pair of electric rail couplings. The 1*a* and 1*b* rails are connected end to end by means of a pair of steel fishplates (10) providing both rigid mechanical and electric connection. Similar fishplates (10) are used in a branch circuit unit (11) which supports and powers a lamp (2), and also in a second branch circuit unit (11) making it possible to power rails from the transformer (3) by means of a pair of cables (12) or other appropriate electric conductors, such as steel rods also serving to support the rails. Another type of branch circuit unit is used to support another lamp (2) shown; this is a magnetically secured connector (13) applied simply against the inner side of a rail (1) and supporting the lamp using the force of magnetic attraction.

In FIG. 2, each rail (1) is made up of two steel bars with identical sections (15), secured one to the other be means of a thin middle strip (16) of synthetic dielectric material which provides the desired insulation between the two poles of the current applied to the pair of bars (15). The strip (16) has two protruding edges (17) forming lips which prolong or interrupt the leak path between adjacent outer surfaces of the two bars.

The rail (1) is symmetrical with respect to a middle plane (18) which ordinarily is vertical when the rail is horizontally disposed. The outside cross section of the rail (1) appears roughly polygonal, and it has, in the present case, the shape of an elongated octagon; that is, a rectangle with its corners cut off. The bars (15) have top sides (20) and bottom sides (21) that are flat and parallel, located respectively in planes 22 and 23 perpendicular to the middle plane (18). Each bar has a lateral side (24) parallel to the plane 18, between two sides (25) and (26) which are at 45° angles to it. Next to the middle plane (18), each of the opposite sides (20) and (21) has a right angle indentation defining a groove (27) with the protruding edge (17) of the insulating strip (16). This groove has an approximately rectangular section, its lateral side (28) being parallel to the 18 plane, and thus also to the side (24) of the bar. The latter is provided with a longitudinal groove (29) with a V section, designed to take the tip of the lock screws described further on.

FIG. 3 shows in greater detail the pair of steel fishplates (10) used in connecting the rails 1*a* and 1*b* mechanically and electrically, the rails being shown as "transparent", using dot and dash lines. Each fishplate (10) is made of a segment of steel section or a section of some other metal, for example brass, and the section corresponds to the outer section of a bar (15) of the rail, the general appearance of which is thus kept. Each fishplate has two opposite edges (30) fitting into the grooves (27) of the corresponding bar (15) and holding the fishplate firmly on the rail. Two borings are threaded in the lateral side (31) of the fishplate, to take locking screws (32) that can be tightened a key with handle for socket screws (33) so that the tip is engaged in the V-shaped groove (29) of the bar (15) to lock the fishplate on the rail. Thanks to this lock, each edge (30) is pressed against the lateral side (28) of the groove (FIG. 2), and this guarantees a rigid connection between rails and fishplates, as well as good electric contact.

Aside from the straight fishplates (10), the device may involve a full assortment of elbow fishplates for assembling rails at an angle to each other. FIG. 4 shows, for example, two assorted fishplates (34 and 35) for joining two rails meeting at right angles in the horizontal plane. Using four fishplates (34), you can make a joint forming a cross. Similar fishplates may be provided for connecting rails at a 45° angle, and other types of elbow fishplates for connecting rails to form angles vertically. All it takes is two set screws (32) to lock each fishplate, so that the outer appearance of the connections is pleasing to the eye.

FIG. 5 shows a perspective view of a well secured branch circuit unit (11) including a pair of fishplates (10) secured rigidly on a rail (1) using their locking screws (32) as described above. In the middle of the lateral wall (31) of each fishplate a lateral socket (34) is secured, which is horizontal in the usual position and which serves to support one of the two conducting rods (35) supporting and powering the lamp (2) in a well known manner (FIG. 1). The socket (34) is provided with a crosswise slit (36), for the rod (35) to pass through, and a threaded axial bore in which a set screw (37) is engaged, which set screw, being tight against the rod (35), provides good electric contact and at the same time secures the lamp mechanically. The socket (34) may be made up of two parts linked by an axial pivot making it possible to turn the slit (36) and the rod (35) in the desired direction, this pivot being locked by tightening the screw (37). It will be noted that the entire branch circuit unit (11), thanks to its being firmly secured to the rail (1), is capable of supporting relatively heavy lamps and to guarantee that they remain stable, through its non-circular shape along with the peculiar shape of the rail. FIG. 6 shows the inner side of a protective end cap (40) made of synthetic insulating material, designed to be fitted over the end of a rail (1) as shown in FIG. 1. The end cap (40) is a moulded part having an outer profile that corresponds to that of the rail (1). It is provided with four parallel "fingers" (41) designed to fit tightly into the grooves (27) of the rail. Thus it is possible to saw the rail to any length desired and to protect the end with the end cap (40) and to cover its sharp edges, eliminating any risk of a short circuit through contact with the flat end of the rail, and also to offer an eye-pleasing appearance thanks to the appropriate shape of the front side of the end piece (40).

FIGS. 7 through 9 show the structure of the insulating securing clamp (5) designed to surround a rail (1) and to support it. This clamp consists of two parts (43 and 44) moulded out of synthetic insulating material, shown in FIGS. 8 and 9 respectively. Part 43 is generally used as the base part, since it is secured to or suspended from a bearing structural element (wall, ceiling, etc.) whereas the other part 44 is a covering part fitted over part 43, to which it is secured by catches. Once fitted together, the two parts form a clamp around the rail, the central opening of the clamp (45) having the same profile as the rail, with the exception of the grooves (27 and 29), so that the rail cannot slip sidewise.

FIG. 8 shows that the base part 43 has a flat top (46) with a hole (47) in the centre through which, for example, a suspension cable or a screw can pass to secure the part to any desired support or to a similar part, as is the case in the device (8) shown in FIG. 1. The top (46) is surrounded by a conical shoulder (48) bearing two parallel lateral claws (49) the free end of which is in the shape of a hook (50) extending outwards. The covering part (44) also has a flat circular bottom or top (51) surrounded by a conical shoulder (52). The latter has two openings on opposite sides (53) where the hooks (50) catch on. Above these openings, the part has two curved side walls (54) making the clamp roughly cylindrical. These opposite walls (54) are designed to squeeze the rail laterally in such a way as to stabilize the clamp lengthwise by friction.

The clamp (5) construction makes it easy to assemble rails (1) once the base parts (43) have been secured to the bearing structure. All you have to do is fit each rail in between the claws (49) of one base part, and then fit the covering part (44) over the latter until the hooks (50), compressed outwards by the flaps (49) held against the rail, catch on. The weight of the rail and the elements it bears is then transmitted from part 44 to part 43 by the hooks (50). Since the latter are visible in the openings (53), you can push them by hand to release them if necessary to open the clamp to remove the rail or to move it.

FIGS. 10 to 12 refer to the magnetically secured electric connector (13), supporting the lamp (2) shown to the right in the example in FIG. 1. This connector has a decorative insulating body (60) made of one part moulded out of synthetic material and having an outside profile which resembles that of the rail (1).

The top edge (61) of the body is cut to conform to the bottom profile of the rail (1). As shown in FIG. 11, the body (60) is hollow and open at the top facing the rail. It contains two contact elements each of which is made up of a steel plate (62), and also a magnet (63) secured between these two plates, for example by pasting. The magnet (63) may be made of some insulating material or may be provided with a insulating coating where in contact with each plate (62). FIG. 12 shows the shape of one of the plates (62), with a rectilinear top edge (64) designed to provide electrical contact with the corresponding conducting bar (15) of the rail (1). Two retainer openings (65) are provided in the plate (62) for two inner teeth (66) of the body (60) to catch on to. Downwards, the plate (62) is extended by a suspension hasp (67) which has a hole (68) and which sticks out from the body (60) through a slit like item 69 in FIG. 10. A socket (34) of the type described above in reference to FIG. 5 is attached to the hasp (68), this socket having a knurled stud (70) tightly fitted into the hole (68). As in the case in FIG. 5, the sockets (34) of the connector support and power the lamp through a pair of steel rods (35). It will be noted that the plates (62) may be replaced with analogous plates each of which has two outside hasps (67) emerging through appropriate slits (69) near the ends of the body (60), to form a connector capable of supporting two lamps, as shown in FIG. 13.

The magnetic attraction between the magnet (63) and the steel bars (15) of the rail is adequate to lock the connector against the rail and bear the weight of lightweight lamps such as halogen spotlights of around 20 W. This is attraction is all the more effective since the magnetic flux can pass directly into the rail through the steel plates (62) applied against the bars (15). Referring to FIG. 2, you notice that the plates (62), held together by the magnet (63), will be applied against the two surfaces (21) located in one and the same plane (23); that is, that the connector is held perfectly stable. The edge (17) of the insulating strip of the rail can be engaged in a corresponding notch (71) of the body (60) so as to keep it centered. In FIG. 11, we have represented with broken lines a variant in which the sockets (34) are replaced by sockets (34') placed on the sides of the body (60) and cross through the body to be secured directly to the plates (62), thus doing away with the outer hasps (67) and also improving the appearance of the connector.

In the variant shown in FIG. 13, the magnetically secured connector (13) is provided with two pairs of outside hasps (67) for supporting and powering two small spotlights (72). Each spotlight (72) has a base unit made of two steel sockets (73) joined by an insulating part (74) and equipped with bores lined up on the same axis in which two elbow rods (75) are locked respectively by screws (76). The top ends of the conducting rods (75) are flattened out and secured against the corresponding hasps (67) by means of screws (77) and by the lined-up lower ends of the rods (75). The preceding description shows that the present invention furnishes a low voltage supporting and powering device which fulfills the goals set, in particular concerning stability, eye appeal, and convenience in use. Furthermore, it is noted that the various elements adapted to the rails are simple, can be manufactured cheap, and make assembly quick and sure, even in the hands of an amateur.

The present invention is not limited to the specimen described above, but it extends to any modification or variant evident to a man of the trade.

I claim:

1. Low voltage supporting and powering device for a lighting installation provided with one or more lamps, including:

at least one section rail made up of two conducting bars separated by an insulating element extending in the middle plane of the rail, insulating suspension means for securing the rail or rails to a bearing structure, low voltage electric powering means, connected to the two conducting bars of a rail, and at least one branch circuit unit designed to be mounted in a position adjustable lengthwise on the rail and supporting a lamp, said unit being comprised of two contact elements which are applied against the conducting bars respectively and which connect the lamp to the rail electrically, characterized in that each conducting bar (15) of a rail (1) has a cross section defining two opposing longitudinal grooves (27), respectively on opposite sides of the rail, in that said opposite sides of the rail extend appreciably in planes (22, 23) perpendicular to the middle plane (18) of the rail, and in that the rail (1) has a polygonal cross section.

2. Device according to claim 1, characterized in that each conducting bar (15) includes a longitudinal V-shaped groove (29) in one lateral side (24) appreciably parallel to the middle plane of the rail.

3. Device according to claim 1, characterized in that each of said opposite grooves (27) is formed by a steplike indentation in the profile of the conducting bar (15), next to the middle plane (18), and in that the two grooves located on the same side of the rail are separated by an outer lip (17) of the insulating element (16).

4. Device according to claim 1, characterized in that it includes a protective end cap (40) made of insulating material, made of one moulded part covering the end of the rail and having four parallel "fingers" (41) fitting longitudinally into said opposite grooves (27).

5. Device according to claim 1, characterized in that the suspension means include insulating clamps (5) arranged so as to surround the rail (1), each clamp being made of two moulded parts (43, 44) made of electrical insulation, which are assembled by catches and which together fine an opening (45) the form of which corresponds to the rail cross section.

6. Device according to claim 5, characterized in that one (43) of the moulded parts includes a top or bottom (46) arranged with respect to one of said flat sides of the rail and provided with a hole (47) for some securing means, and a pair of parallel flaps (49) extending over the lateral sides of the rail and provided with hooks (50) pointed outwards, and in that the other part (44) includes a pair of lateral sides (54) covering said flaps and holes (53) which said hooks (53) catch on to.

7. Device according to claim 1, characterized in that one branch circuit unit is formed by a magnetically secured electric connector (13) , arranged to be applied against one of said opposite sides of the rail and including a magnet (63) arranged between said contact elements (62) and secured to them, these contact elements being applied against the conducting bars (15) by the force of magnetic attraction and bearing a lamp by means of two respective conducting elements (35 and 75).

8. Device according to claim 2, characterized in that it includes steel fishplates (10, 34, and 35) designed to be fitted in pairs on the pairs of conducting bars (15) of one or more rails, in particular to connect the ends of two rails mechanically and electrically, each fishplate having a cross section which conforms to the outer profile of the corresponding conducting bar, with two inside opposite edges (30) being positively engaged in said opposite grooves (27) of the bar, and at least two locking screws (32) arranged so as to tighten against the V-shaped groove (29) of the bar.

9. Device according to claim 8, characterized in that one positively secured branch circuit unit (11) includes a pair of said fishplates (10), equipped with a pair of respective lateral sockets (34) provided with securing devices (36, 37) for a pair of conducting elements (35) supporting and powering a lamp.

* * * * *